US012038262B1

(12) United States Patent
Roy

(10) Patent No.: US 12,038,262 B1
(45) Date of Patent: Jul. 16, 2024

(54) MECHANICAL SELF-PERCUSSION FUZE FOR A NON-GYRATING AMMUNITION

(71) Applicant: DIXI MICROTECHNIQUES, Marchaux-Chaudefontaine (FR)

(72) Inventor: Luc Roy, Montboillon (FR)

(73) Assignee: DIXI MICROTECHNIQUES, Marchaux-Chaudefontaine (FR)

( * ) Notice: Subject to any disclaimer, the term of this patent is extended or adjusted under 35 U.S.C. 154(b) by 0 days.

(21) Appl. No.: 18/683,160

(22) PCT Filed: Jul. 7, 2022

(86) PCT No.: PCT/EP2022/068865

§ 371 (c)(1),
(2) Date: Feb. 12, 2024

(87) PCT Pub. No.: WO2023/046327

PCT Pub. Date: Mar. 30, 2023

(30) Foreign Application Priority Data

Sep. 27, 2021 (FR) ..... 2110056

(51) Int. Cl.
*F42C 15/295* (2006.01)
*F42C 1/02* (2006.01)
(Continued)

(52) U.S. Cl.
CPC ..... *F42C 15/295* (2013.01); *F42C 1/02* (2013.01); *F42C 9/02* (2013.01); *F42C 15/005* (2013.01);
(Continued)

(58) Field of Classification Search
CPC .... F42C 1/02; F42C 9/02; F42C 9/141; F42C 15/005; F42C 15/188; F42C 15/20; F42C 15/24; F42C 15/295
(Continued)

(56) References Cited

U.S. PATENT DOCUMENTS 1,916,244 A 7/1933 Woodberry
2,644,398 A 7/1953 Rabinow
(Continued)

FOREIGN PATENT DOCUMENTS

FR 2927695 A1 * 8/2009 ..... F42C 15/295
KR 20140073596 A * 6/2014 ..... F42C 15/295
(Continued)

OTHER PUBLICATIONS

Written Opinion of the International Searching Searching Authority for PCT/EP2022/068865 (English translation) (Year: 2022).*
(Continued)

*Primary Examiner* — James S Bergin
(74) *Attorney, Agent, or Firm* — MARSHALL, GERSTEIN & BORUN LLP

(57) ABSTRACT

A mechanical self-percussion fuze for a non-gyrating ammunition includes a firing pin disposed along a central axis and a primer provided in a primer holder. The primer holder is movable about an axis of rotation that is parallel and off-centered with respect to the central axis between a storage position in which the primer is off-centered with respect to the firing pin and an armed position in which the primer is aligned with the firing pin and safety devices coupled to the primer holder in order to keep the fuze in a safe state until at least two mutually independent physical phenomena linked to the firing of the ammunition occur. The fuze has a wind turbine designed to be driven in rotation by the relative movement of the air during the flight of the ammunition and to transmit this rotational movement to the primer holder only after the safety devices have been removed.

18 Claims, 12 Drawing Sheets

(51) Int. Cl.

| | |
|---|---|
| ***F42C 9/02*** | (2006.01) |
| ***F42C 15/00*** | (2006.01) |
| ***F42C 15/188*** | (2006.01) |
| ***F42C 15/20*** | (2006.01) |
| ***F42C 15/24*** | (2006.01) |

(52) U.S. Cl.
CPC ..... *F42C 15/188* (2013.01); *F42C 15/20* (2013.01); *F42C 15/24* (2013.01)

(58) Field of Classification Search
USPC ..... 102/202.1, 247–253
See application file for complete search history.

(56) References Cited

U.S. PATENT DOCUMENTS 2,748,708 A * 6/1956 Bertram ..... F42C 15/26 102/226
2,795,190 A * 6/1957 Harmon ..... F42C 15/295 102/263
2,817,295 A * 12/1957 Wylie ..... F42C 15/295 102/226
3,611,943 A * 10/1971 Popper ..... F42C 15/295 102/225
3,742,854 A * 7/1973 Donahue ..... F42B 12/10 102/397
3,842,743 A * 10/1974 Zittle ..... F42C 15/44 102/228
6,463,855 B2 * 10/2002 Zehnder ..... F42C 15/295 102/221

FOREIGN PATENT DOCUMENTS

WO WO-03/095933 A1 11/2003
WO WO-2023046327 A1 * 3/2023 ..... F42C 15/295

OTHER PUBLICATIONS

Machine translation of KR-20140073596-A (Year: 2014).*
Machine translation of FR-2927695-A1 (Year: 2009).*
International Search Report and Written Opinion, corresponding International Application No. PCT/EP2022/06885, mailing date Oct. 6, 2022.

* cited by examiner

MECHANICAL SELF-PERCUSSION FUZE FOR A NON-GYRATING AMMUNITION

TECHNICAL FIELD

The present invention relates to a mechanical self-percussion fuze for a non-gyratory ammunition, said fuze comprising a fuze body extending along a central axis between a distal end provided with a cap and a proximal end provided with a connector to assemble said fuze to an ammunition, said fuze comprising a firing pin disposed along said central axis, a primer provided in a primer holder arranged to be rotatably movable about an axis of rotation, parallel and off-centered with respect to said central axis between at least one storage position, in which said primer is off-centered with respect to said firing pin and an armed position, in which said primer is aligned with said firing pin and the pyrotechnical chain of the ammunition, and a mechanism provided with at least two safety devices coupled to said primer holder to keep said fuze in a safe state until at least two mutually independent physical phenomena linked to the firing of said round occur.

BACKGROUND

Mechanical fuzes for rounds are mechanisms having the main function of ensuring rounds are kept safe in their different life phases (storage, handling, transport, manoeuvres in operation zones, loading the ammunition and firing), then ensuring the operation of these rounds as soon as the required conditions are met, and this by way of purely mechanical safety devices. More specifically, at the time of firing the ammunition, the safety of the ammunition must be guaranteed from the time when it is loaded into a weapon to be fired, and up to a distance called "safety distance", beyond which the fired round can no longer have any damaging effect on the personnel having used it. The fuze must further enable the operation of the ammunition (moving from the safe state to the armed state) from a distance called "certain weapon distance". Yet, weapons are provided to fire different loads, making it possible to reach targets which are farther away or closer. These loads are characterised, among others, by a quicker or slower linear speed of the ammunition.

The development of safety standards applicable to rounds has shown the requirement of a dual storage safety device, which must only be able to be removed through the occurrence of two physical phenomena linked to the firing of the ammunition, but which are mutually independent (Stanag 4187). The effect of the linear acceleration of the ammunition linked to starting firing constitutes the first physical phenomenon which can be used to remove a first storage safety device. On weapons operating with rotation of the ammunition, the effect of the centrifugal force of the gyrating ammunition linked to the rotation speed in flight constitutes the second physical phenomenon which can be used to remove a second storage safety device. But, on weapons operating without rotation of the ammunition, therefore not generating the centrifugal force, it is particularly difficult to obtain a second storage safety device independent of the linear acceleration of the non-gyratory ammunition linked to starting firing.

Current mechanical solutions are of different types: implementation of a finger for the presence of the ammunition in the gun, detection of the flight deceleration of the ammunition or detection of the gas pressure in the gun. These solutions all have disadvantages linked to their implementation, their reliability, even their feasibility according to the type of fuze in question. Some of these solutions do not meet the standards on the independence of events to enable arming with the ammunition. Furthermore, these solutions are not satisfactory, given that they do not integrate an adaptive function which enables them to ensure a certain arming distance and a safety distance, which are fixed or constant, whatever the load at which the ammunition is fired.

Other mechanical solutions implement a wind turbine to utilise the effect of the aerodynamic force linked to the relative movement of the air, when the ammunition is in flight and achieve the second storage safety device. Publication FR 2 927 695 A1 describes one of these solutions, which is used to release a lock. However, this solution integrates no adaptive function. Consequently, the greater the load is, the quicker the lock will be released, and the shorter the certain and safety arming distances will be. There is, in this case, a high risk for personnel on the ground, if the fired round explodes at a short distance.

Publication WO 03/095933 A1 describes another solution of a fuze equipped with a wind turbine also used to release a safety lock. Upon starting firing, the wind turbine is unscrewed, rises, and releases the primer holder which can rotate and align the firing pin on the primer. As in the preceding example, this solution integrates no adaptive function. Publication U.S. Pat. No. 1,916,244 A describes a similar device.

Publication U.S. Pat. No. 2,644,398 A describes an electrical fuze comprising a wind turbine arranged to drive a generator provided to supply the detonator of the electrical fuze with current, and a friction clutch coupled to a clock. This old technology no longer meets the standards in force, and is very far away from the invention.

SUMMARY OF THE DISCLOSURE

The present invention aims to overcome these disadvantages by proposing a fuze provided with an exclusively mechanical, reliable and efficient solution for keeping safe for a non-gyratory ammunition, which utilises the relative movement of the air with respect to the ammunition during its flight as a second physical phenomenon independent from the first physical phenomenon linked to the linear acceleration upon starting firing, this solution being applicable whatever the type of fuze, and having an adaptive function making it possible to guarantee a certain arming distance and a constant safety distance, whatever the load at which the ammunition is fired.

For this purpose, the invention relates to a fuze of the type indicated in the preamble, characterised in that it comprises a wind turbine arranged to be driven in rotation by the relative movement of the air with respect to the ammunition during its flight, and to generate the rotational torque necessary for the operation of said mechanism, which regulates the time necessary for the fuze to move from the secure state to an armed state, thus guaranteeing an expected safety distance, whatever the load with which the ammunition is fired.

The invention is advantageous in that it proposes the use of the relative movement of the air by a wind turbine to achieve the second storage security lock in the sense of the standard Stanag 4187 for a weapon which does not generate a centrifugal effect.

In a preferred embodiment of the invention, said wind turbine is provided with a drive shaft, combined with the central axis of said fuze body and secured to said firing pin. Said turbine advantageously comprises blades which extend radially from a central zone, and the cap of said fuze comprises at least one axial air inlet orifice to the right of said central zone and several radial air flow orifices at the outlet of said blades to cause a rotation of said wind turbine in a direction of rotation.

Preferably, said fuze comprises a locking system arranged to, in the locked position, prevent the rotation of the wind turbine and keep the fuze in a safe state before firing the ammunition, and in the unlocked position, enabling the rotation of the wind turbine after firing the ammunition.

In the preferred embodiment of the invention, said locking system comprises an inertial socket associated with a return member, said inertial socket being slidingly mounted in the central axis of said fuze body, to be movable between said locked position, in which said inertial socket is subjected by said return member in a high position, and rotatably blocks said wind turbine, and said unlocked position, in which said inertial socket is moved into a low position under the effect of the linear acceleration upon starting firing, constrains said return member and releases the rotation of said wind turbine.

Said locking system can further comprise at least one axial indexing finger provided on one of the parts of said wind turbine or of said inertial socket and an axial orifice provided on the other of the parts of said inertial socket or of said wind turbine, said axial indexing finger being housed in said axial orifice, when said inertial socket is in high position in said locked position, to rotatably block said wind turbine.

Said locking system can also comprise at least one radial guiding finger, provided on one of the parts of said fuze body or of said inertial socket, and an axial groove provided on the other of the parts of said inertial socket or of said fuze body, said radial guiding finger being housed in said axial groove, when said inertial socket is in high position in said locked position, to rotatably block said inertial socket.

Said locking system can finally comprise a blocking element arranged to keep said inertial socket in a low position in said unlocked position. Said blocking element can comprise at least one ball in a lateral housing provided in one of the parts of said inertial socket or of said fuze body, and a lateral opening provided in the other of the parts of said fuze body or of said inertial socket, said ball being arranged to be moved between said lateral housing and said lateral opening when they face one another.

In the preferred embodiment of the invention, said fuze comprises at least one inertial lock arranged to link said primer holder to said fuze body, and keep said primer holder in the storage position, said inertial lock forming part of the other of said safety devices, which has the advantage of reacting to the linear acceleration upon starting firing.

Said fuze advantageously comprises at least one locking member arranged to link said primer holder to said fuze body and keep said primer holder in the storage position, said locking member forming part of one of said safety devices which has the advantage of reacting to the linear speed of the ammunition during its flight. Said locking member can comprise a ball in said primer holder, encased with a hemispherical footprint of said fuze body.

Advantageously, said fuze comprises a rotor superposed to said primer holder, and the drive shaft of said wind turbine comprises a motor pinion arranged to mesh a receiver pinion of said rotor and drive it in rotation about said axis of rotation.

Preferably, said rotor comprises a hemispherical footprint arranged to be positioned facing the ball in said primer holder and enable it to rise to release said primer holder.

Said primer holder and said rotor are advantageously coupled to one another by a coupling device on a determined angular sector, during which the rotation of said rotor drives the rotation of said primer holder moving from said storage position to said armed position. Said coupling device comprises a coupling finger provided on one of the parts of said primer holder or of said rotor, and a circular oblong space on the other of the parts of said rotor or of said primer holder. Said rotor is further provided to mesh a chronometric gear train arranged to regulate the movement of said rotor.

Advantageously, said fuze comprises a collar, secured to the drive shaft of said wind turbine, arranged to break under the effect of an impact transmitted by said cap and enable said firing pin to descend and ram said primer and initiate the pyrotechnical chain, leading to the destruction of the ammunition.

BRIEF DESCRIPTION OF THE DRAWINGS

The present invention and its advantages will best appear in the description below of several embodiments given as non-limiting examples, in reference to the accompanying drawings, in which.

DETAILED DESCRIPTION

Figure 1:
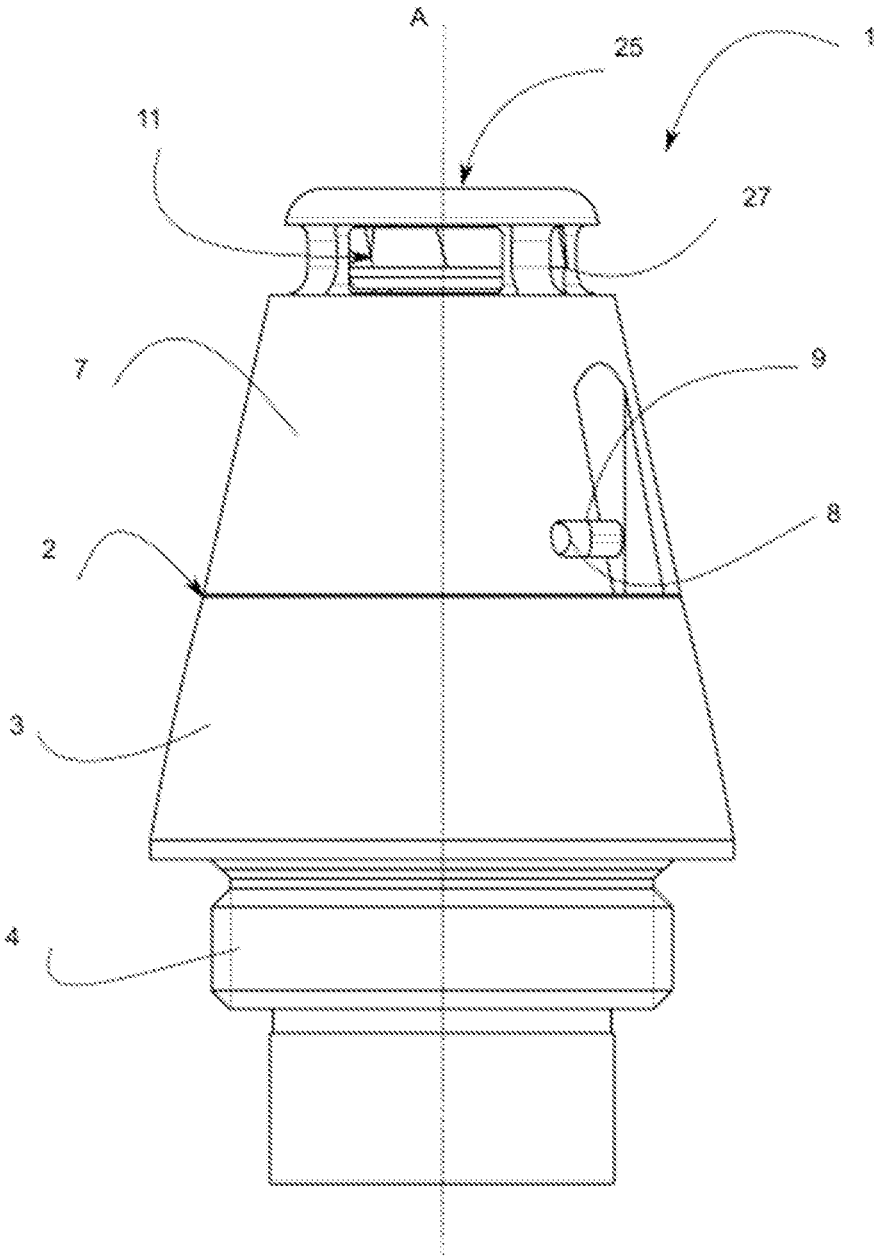
FIG. 1 is a planar view of a fuze according to the invention.

In the embodiments illustrated, identical elements or parts have the same reference numbers. Furthermore, the terms which have a relative meaning, such as vertical, horizontal, right, left, front, rear, above, below, top part, bottom part, etc. must be interpreted under the conditions of representation of the invention according to the FIGURES. Moreover, the geometric positions indicated in the description and the claims, such as "perpendicular", "parallel", "symmetrical" are not limited in the strict sense defined in geometry, but extend to geometric positions which are close, i.e. which accept a certain tolerance in the technical field in question, without impact on the result obtained. This tolerance is, in particular, introduced by the adverb "substantially", without this term necessarily being repeated before each adjective.

The invention particularly relates to non-gyratory ammunitions, which are rounds of extended shape along a central axis, being moved without rotating on themselves and are stabilised by feathering. Below in the description, the generic term "round" is used, which applies to any type of rounds, projectiles, rockets, and similar. The ammunition (not represented) is not described as such, as it does not form part of the invention. It mainly contains explosive loads.

The invention more specifically relates to the fuze which is assembled at the top of the ammunition. The fuze contains, in a known manner, a mechanical firing pin and a percussion primer containing a pyrotechnical component such as a detonator. It makes it possible, during the impact of the ammunition on a target, to initiate a polytechnical chain which will activate the explosive loads and cause the destruction of the ammunition.

In reference to the FIGURES, the mechanical self-percussion fuze 1 for a non-gyratory ammunition according to the invention comprises a substantially truncated fuze body 2, extending along a central axis A. The fuze body 2 is constituted of a base 3 provided with a connector 4 to be assembled to the ammunition and with a central housing 5 passing through to receive the top part of the ammunition and connect the explosive loads to the percussion primer. The fuze body 2 further comprises a cap holder 6 surmounted by a cap 7 able to be deformed in case of impact. The cap 7 is linked to the cap holder 6 by radial pins 8 through spaces 9 provided in the cap 7, or by any other equivalent assembly means.

Figure 3:
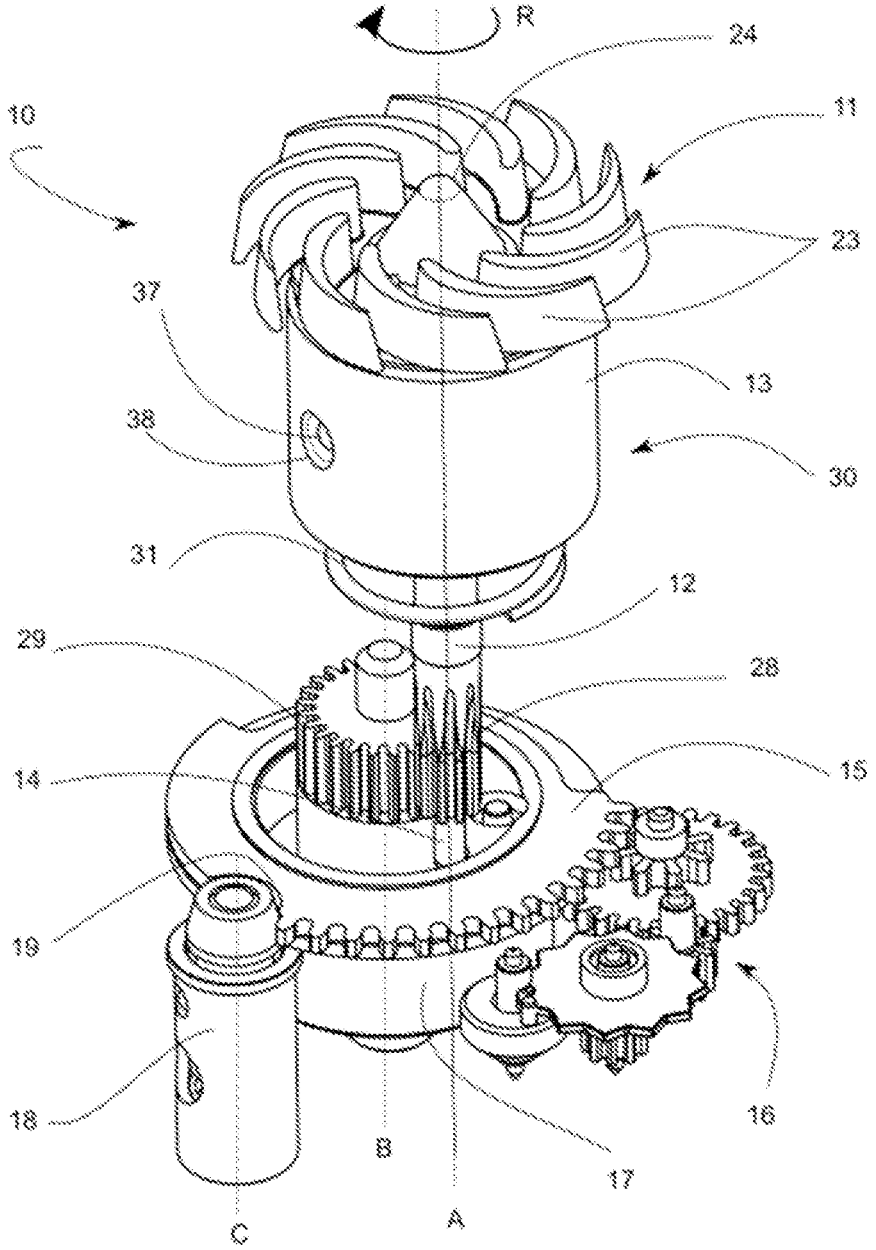
FIG. 3 is a perspective view of the mechanism contained in the fuze of FIG. 2.

The fuze 1 comprises a mechanical 10 with several safety levels to keep the ammunition in a safe state, until at least two mutually independent phenomena linked to the firing of the ammunition occur. The mechanism 10 is represented in FIG. 3 and comprises, from top to bottom:—a wind turbine 11 provided with a drive shaft 12 combined with the central axis A of the fuze,

- an inertial socket 13 disposed under the wind turbine 11,
- a firing pin 14 secured to the drive shaft 12, and disposed at the opposite end of the wind turbine 11,
- a rotor 15 driven in rotation by the wind turbine 11 about an axis of rotation B, off-centered and parallel to the central axis A,
- a chronometric gear train 16 to regulate the movement of the rotor 15,
- a primer holder 17 disposed under the rotor 15, and arranged to be driven in rotation by the rotor 15 about the axis of rotation B, and
- an inertial lock 18 disposed on an axis C parallel to the axis of rotation B and housed in a lateral notch 19 of the rotor 15 and of the primer holder 17.

The top part of the mechanism 10 is mounted in the cap holder 6. The cap holder 6 comprises a central bore 20 of axis combined with the central axis A of the fuze, arranged to guide in axial rotation and in axial translation, the drive shaft 12 of the wind turbine 11. It also comprises an annular housing 21 under the wind turbine 11 to receive the inertial socket 13. The low part of the mechanism 10 is mounted in a safety device holder 22, itself mounted in the base 3 of the fuze.

The wind turbine 11, also called turbine 11 below, extends perpendicularly to the drive shaft 12 and comprises blades 23 which extend radially from a central zone 24 combined with the drive shaft 12. The blades 23 have a curved shape to generate a rotation of the turbine in the direction of the arrow R (FIG. 3). The central zone 24 has a substantially conic shape, provided with a top centred on the central axis A and oriented in the direction of the end of the cap 7, forming the distal end 25 of the fuze 1. The cap 7 comprises an axial air inlet orifice 26 to the right of the central zone 24 of the turbine 11 and several radial air flow orifices 27 at the outlet of the blades 23. The drive shaft 12 of the turbine 11 comprises a toothed pinion, called motor pinion 28, arranged to mesh a receiver pinion 29 secured to the rotor 15 of the primer holder 17. Naturally, any other technically equivalent wind turbine shape can be suitable.

Figure 4:
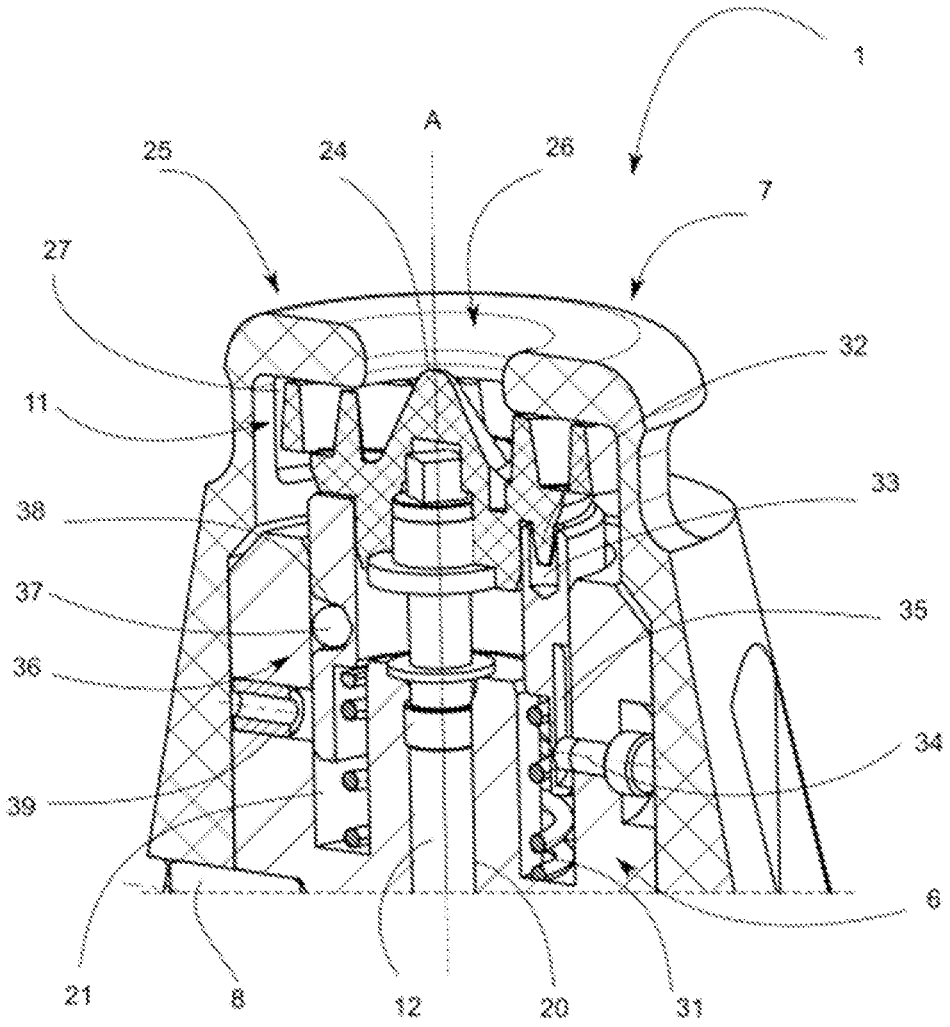
FIG. 4 is an enlarged cross-sectional view of the top part of the fuze of FIG. 2, showing the wind turbine in a high locked position.
Figure 5:
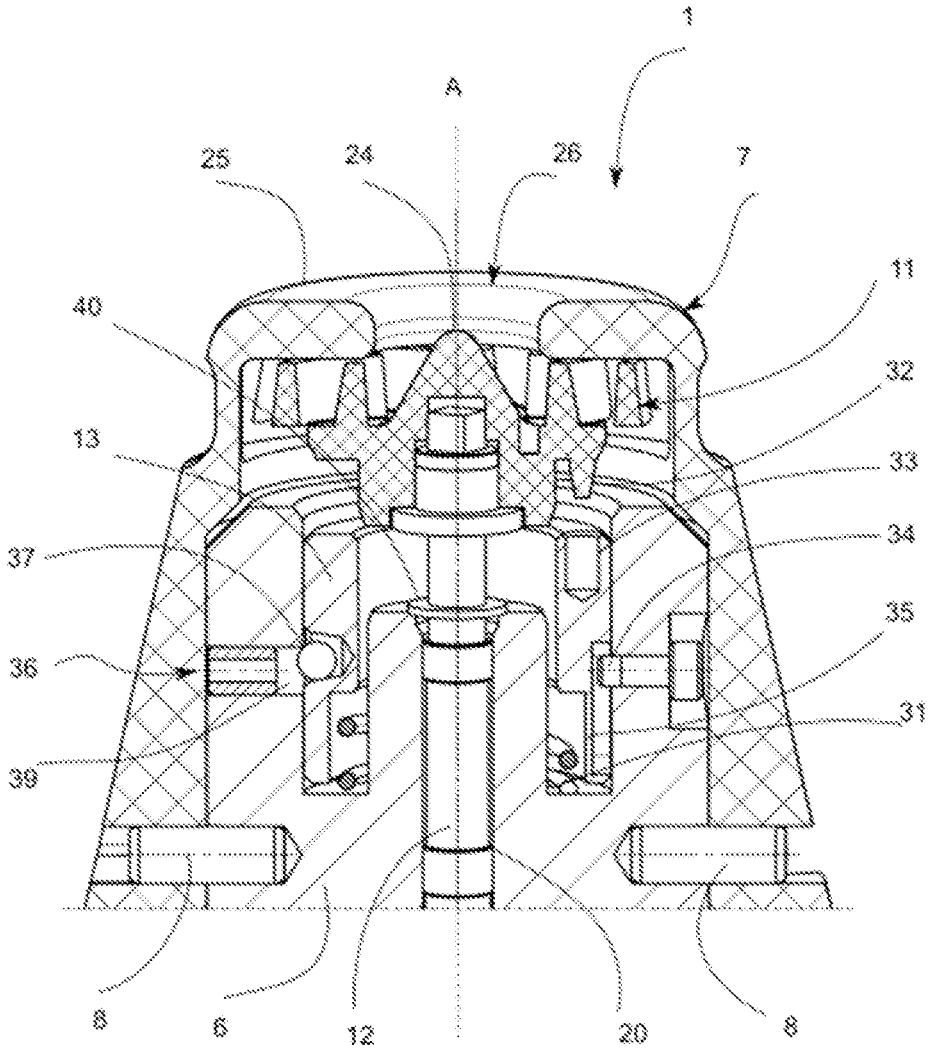
FIG. 5 is a view similar to FIG. 4, showing the wind turbine in a low unlocked position.

More specifically, in reference to FIGS. 4 and 5, the fuze 1 comprises a locking system 30 arranged to, in the locked position, prevent the rotation of the turbine 11 when the fuze 1 is in the storage position before firing the ammunition, and in the unlocked position, enable the rotation of the turbine 11 after firing the ammunition. This locking system 30 comprises the inertial socket 13, which is axially slidingly mounted in the annular housing 21 provided in the cap holder 6 to be movable between the locked position and the unlocked position. It comprises a return member 31, such as a helical spring, without this example being limiting, disposed in the annular housing 21 of the cap holder 6 under the inertial socket 13 to constrain it in the locked position, in which it is in the high position flattened against the turbine 11, which turbine 11 is in high abutment against the cap 7. The locking system 30 further comprises at least one axial indexing finger 32 provided on the body of the turbine 11 and projecting inside at least one axial orifice 33 provided in the inertial socket 13 to prevent the wind turbine 11 to rotate in this locked position. It also comprises a radial guiding finger 34 provided in the cap holder 6 and opening into an axial groove 35 of the inertial socket 13 to prevent the inertial socket 13 to rotate. Naturally, the different solutions described and illustrated in reference to the FIGURES are non-limiting examples of embodiments, and any other technical solution fulfilling the same blocking function in rotation can be suitable.

Under the effect of the linear acceleration, upon starting firing, the inertial socket 13 is axially retracted and moves from the locked position to the unlocked position, in which it is in the low position, constrains the return member 31 and releases the turbine 11 which can rotate. The locking system 30 further comprises a blocking element 36 arranged to block the inertial socket 13 in the low position when it is in the unlocked position. This blocking element 36 comprises a ball 37 provided in a lateral housing 38 of the socket and a lateral opening 39 provided in the cap holder 6. When the inertial socket 13 is retracted, it drives the ball 37 with it, and when the ball 37 arrives facing the lateral housing 38, it is housed there and prevents the socket from rising. Naturally, any other technical solution fulfilling the same blocking function in the locked position can be suitable.

The wind turbine 11 thus released is kept in its initial high position by a collar 40 projecting radially from its drive shaft 12 which bears on the cap holder 6, also keeping the firing pin 14 in the high position.

The primer holder 17 has a safety function and makes it possible to keep a primer 17' off-centered or misaligned with respect to the pyrotechnical chain and to the firing pin 14. The axis of the pyrotechnical chain is combined with the central axis A. The primer holder 17 is associated with safety devices provided in the mechanism 10 to keep the ammunition in a safe state during phases of storing, transporting, handling and loading the ammunition in a weapon until starting firing, and even after starting firing over a predetermined safety distance. This position of the primer holder 17 is called a storage position. It is only after having detected and reacted to at least two ballistic firing events (linear acceleration of the ammunition and relative movement of the air with respect to the ammunition) that the safety devices provided in the mechanism 10 enable the primer holder 17 to be moved to align the primer 17' with the firing pin 14 and the pyrotechnical chain. This position of the primer holder is called an armed position.

Figure 2:
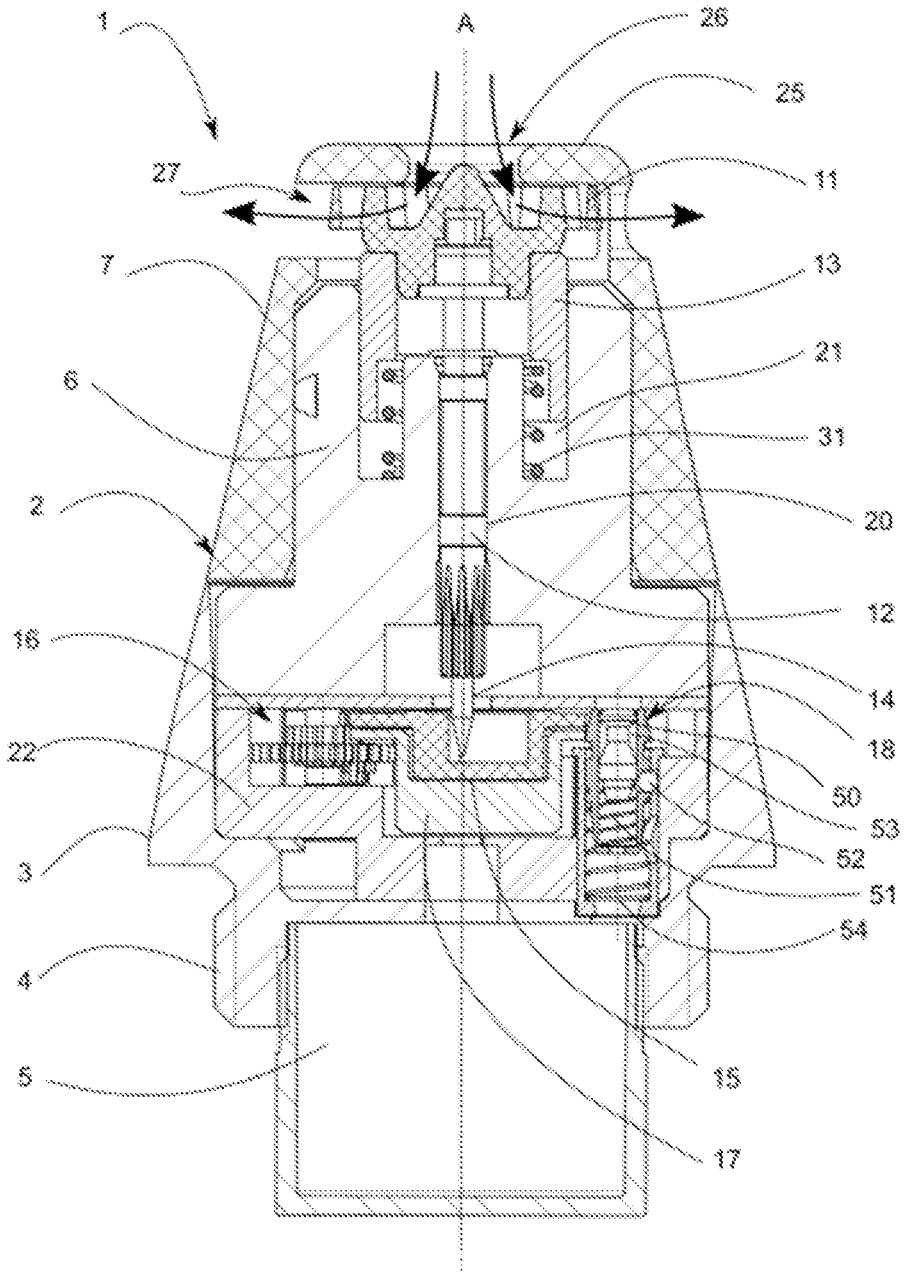
FIG. 2 is an axial cross-sectional view of the fuze of FIG. 1.
Figure 6:
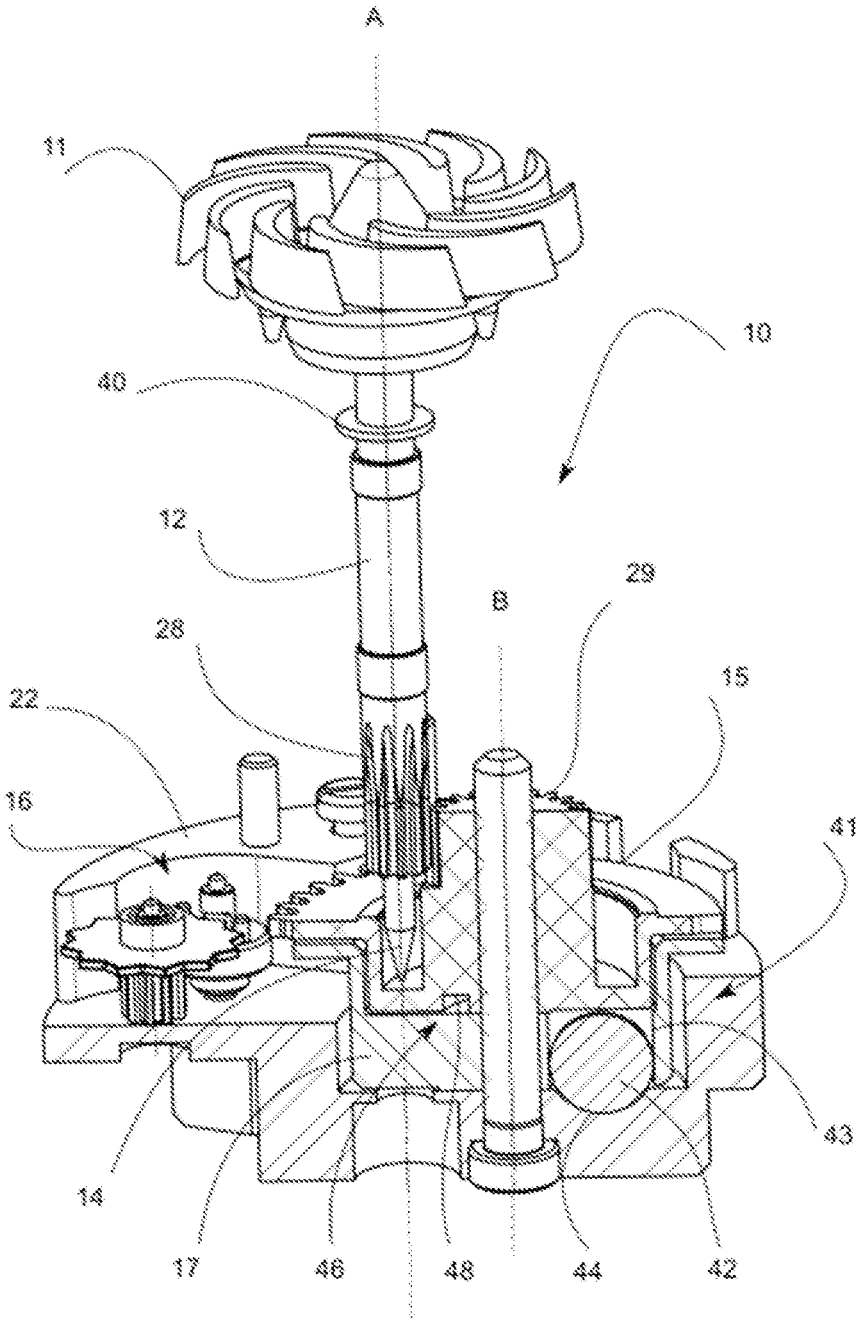
FIG. 6 is a cross-sectional, perspective view of a part of the mechanism contained in the fuze of FIG. 2, showing the rotor driven by the wind turbine, while the primer holder is in the storage position.

In reference to FIGS. 2 and 6, the primer holder 17 is kept in the storage position by two independent safety elements: the inertial lock 18 of axis C on the one hand, and a locking member 41 on the other hand. The principle of an inertial lock 18 is commonly used in the field of rounds. In the example represented in FIGS. 2 and 3, the inertial lock 18 comprises an inner mass 50, subjected in a high position by an inner spring 51, a ball 52 radially housed between the inertial lock 18 and the inner mass 50, and an outer spring 54 to subject the inertial lock 18 in the high position corresponding to the storage position. Upon starting firing, under the effect of acceleration, the inner mass 50 descends and compresses the inner spring 51. The inner mass 50 being in the low position, the ball 52 is removed in a peripheral clearance 53 of the inner mass 50 and releases the inertial lock 18. Under the effect of acceleration, the inertial lock 18 descends, compresses the outer spring 54 and unlocks the primer holder 17. At the end of acceleration, the inner mass 50 rises and locks the inertial lock 18 in the low position by way of the ball 52 which is radially housed between the inertial lock 18 and a radial clearance 55 provided in the safety device holder 22. Any other technically equivalent inertial means can be suitable.

Figure 7:
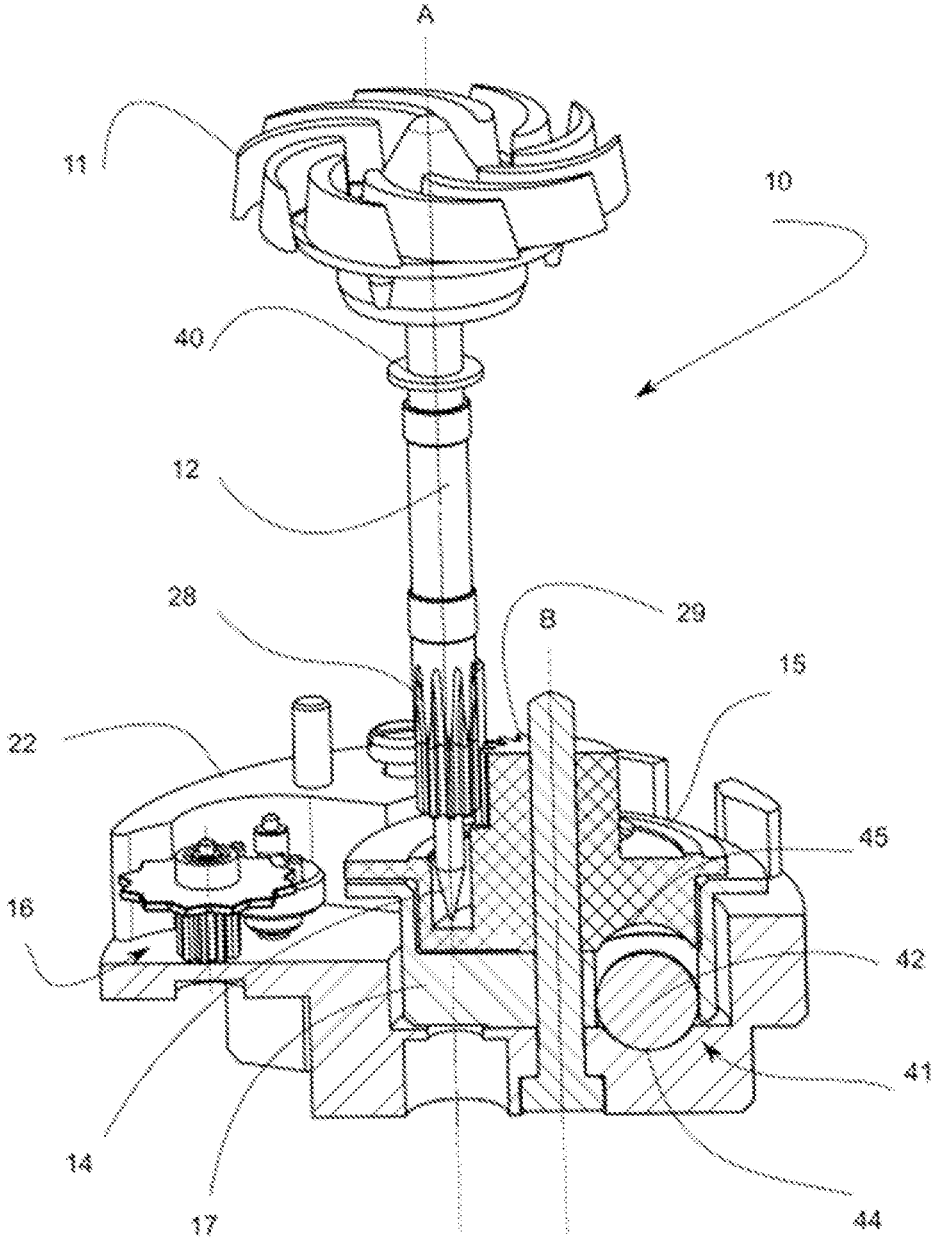
FIG. 7 is a view similar to FIG. 6, showing the rotor driven by the wind turbine, in an intermediate position.
Figure 8:
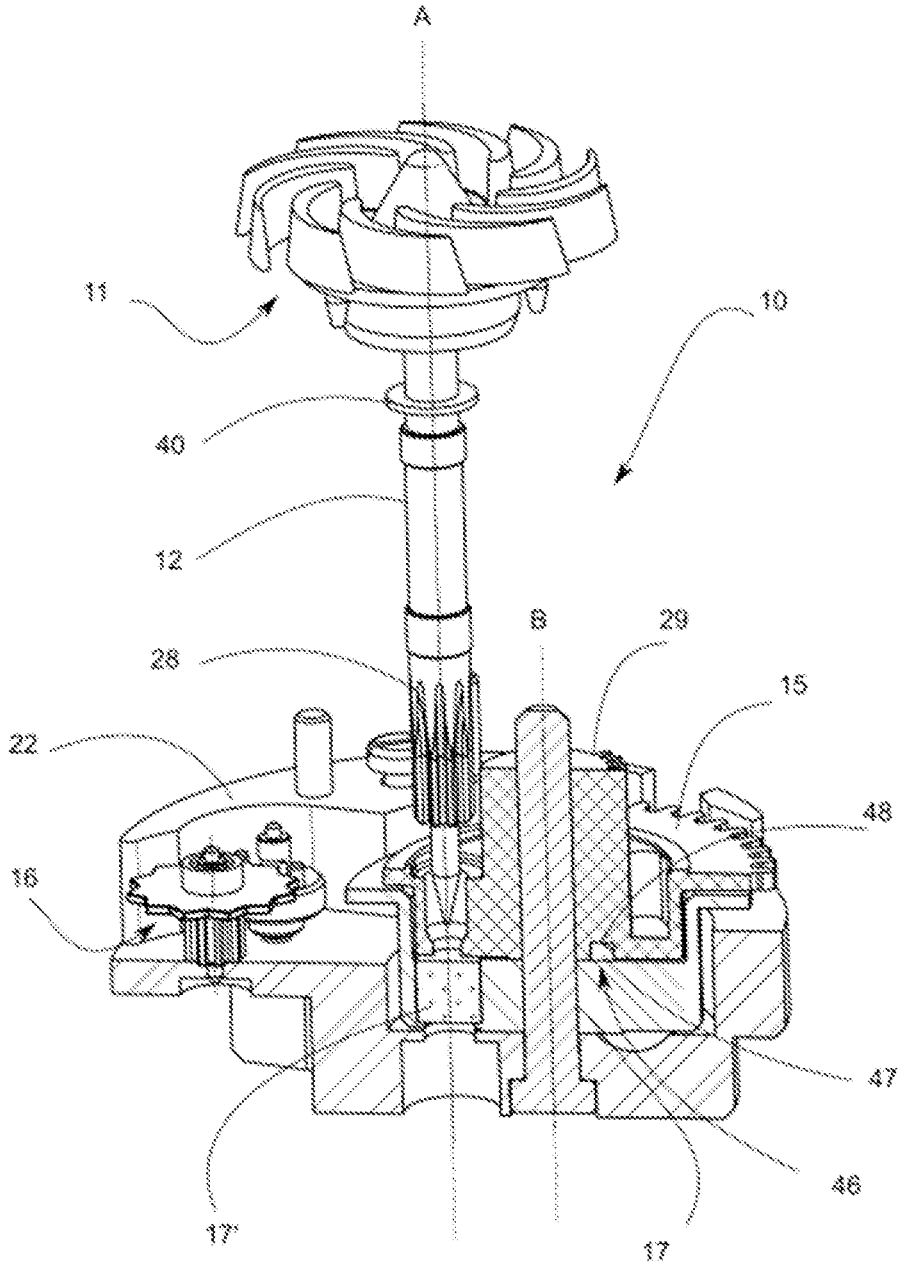
FIG. 8 is a view similar to FIG. 6, showing the rotor driven by the wind turbine, moving the primer holder into the armed position.
Figure 9:
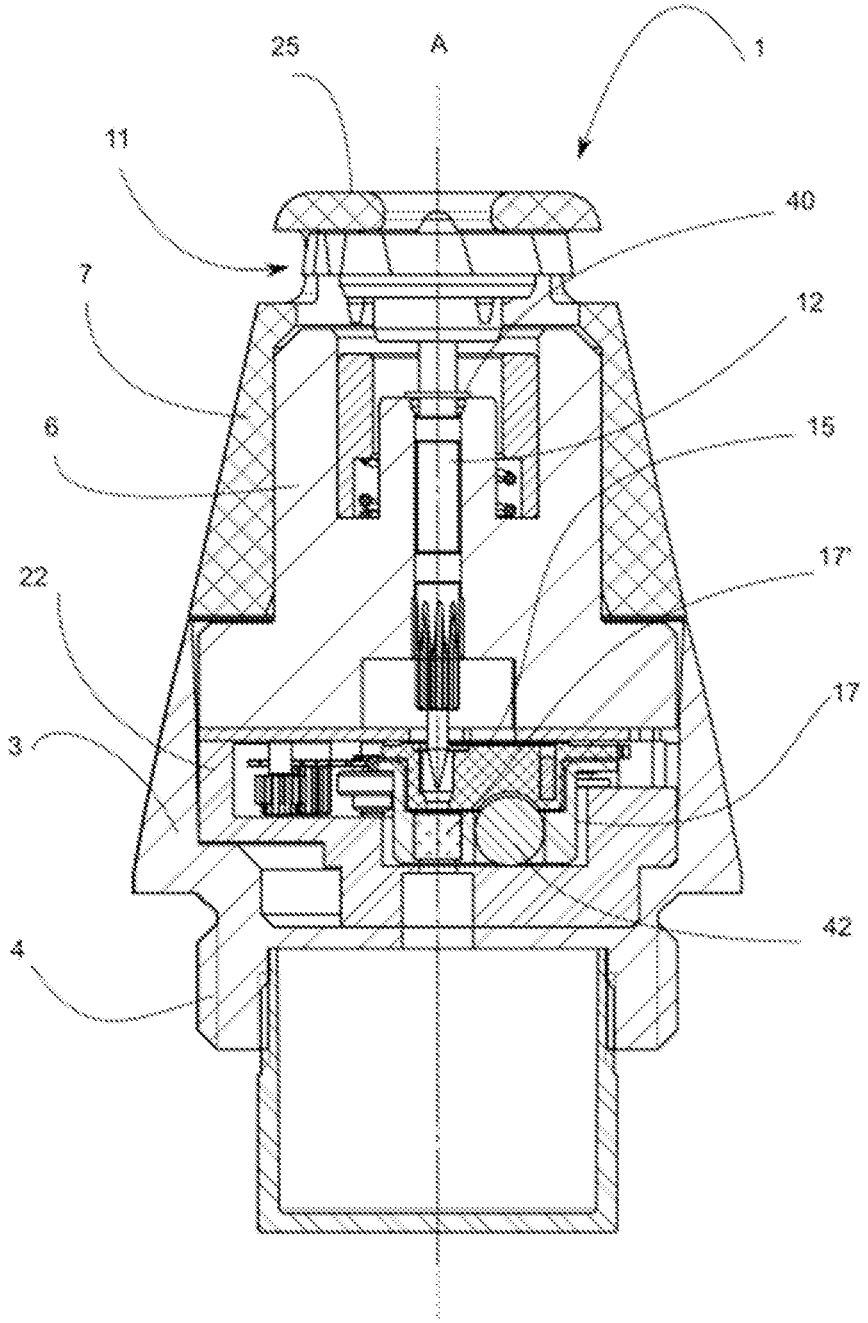
FIG. 9 is a cross-sectional view of the fuze of FIG. 2, showing the fuze in an armed state.
Figure 10:
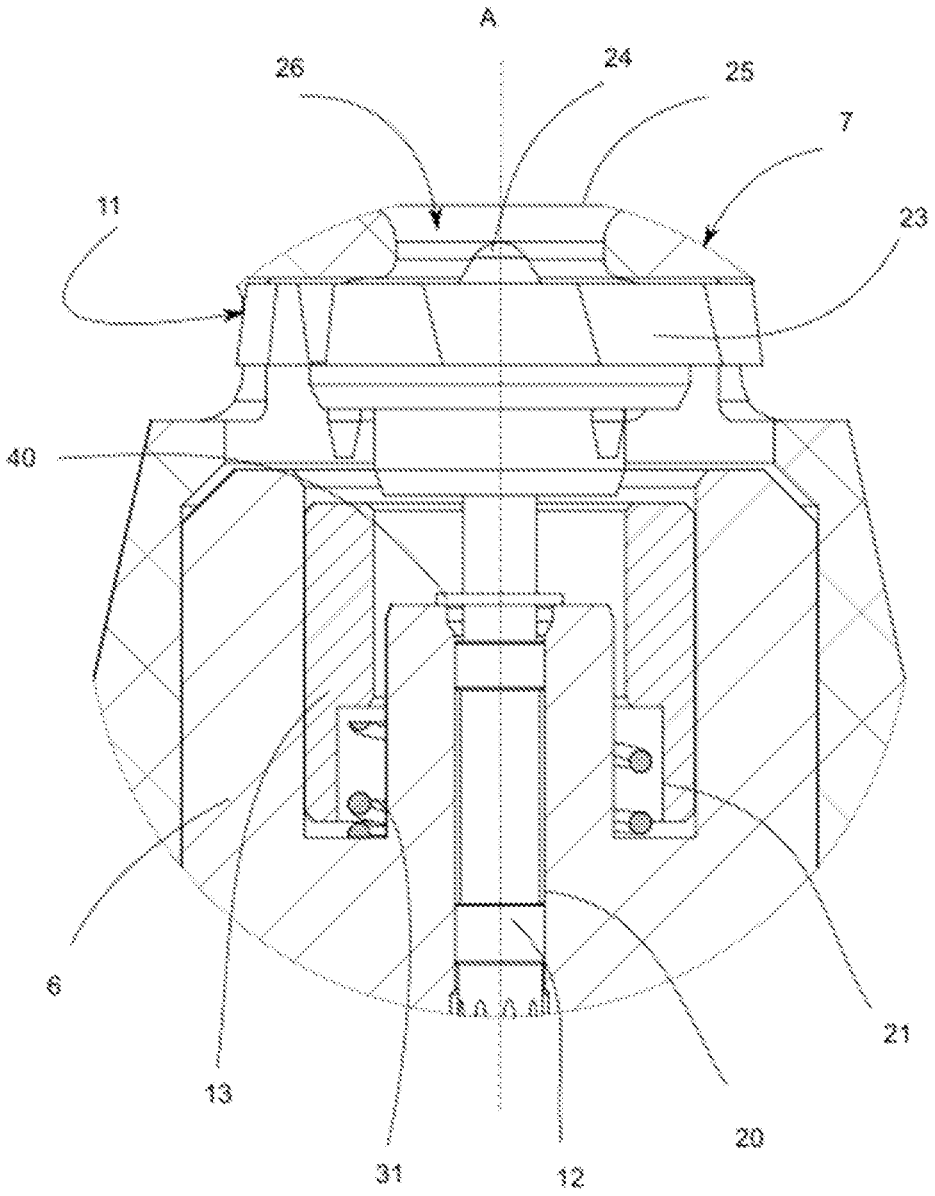
FIG. 10 is an enlarged cross-sectional view of the top part of the fuze of FIG. 9.
Figure 11:
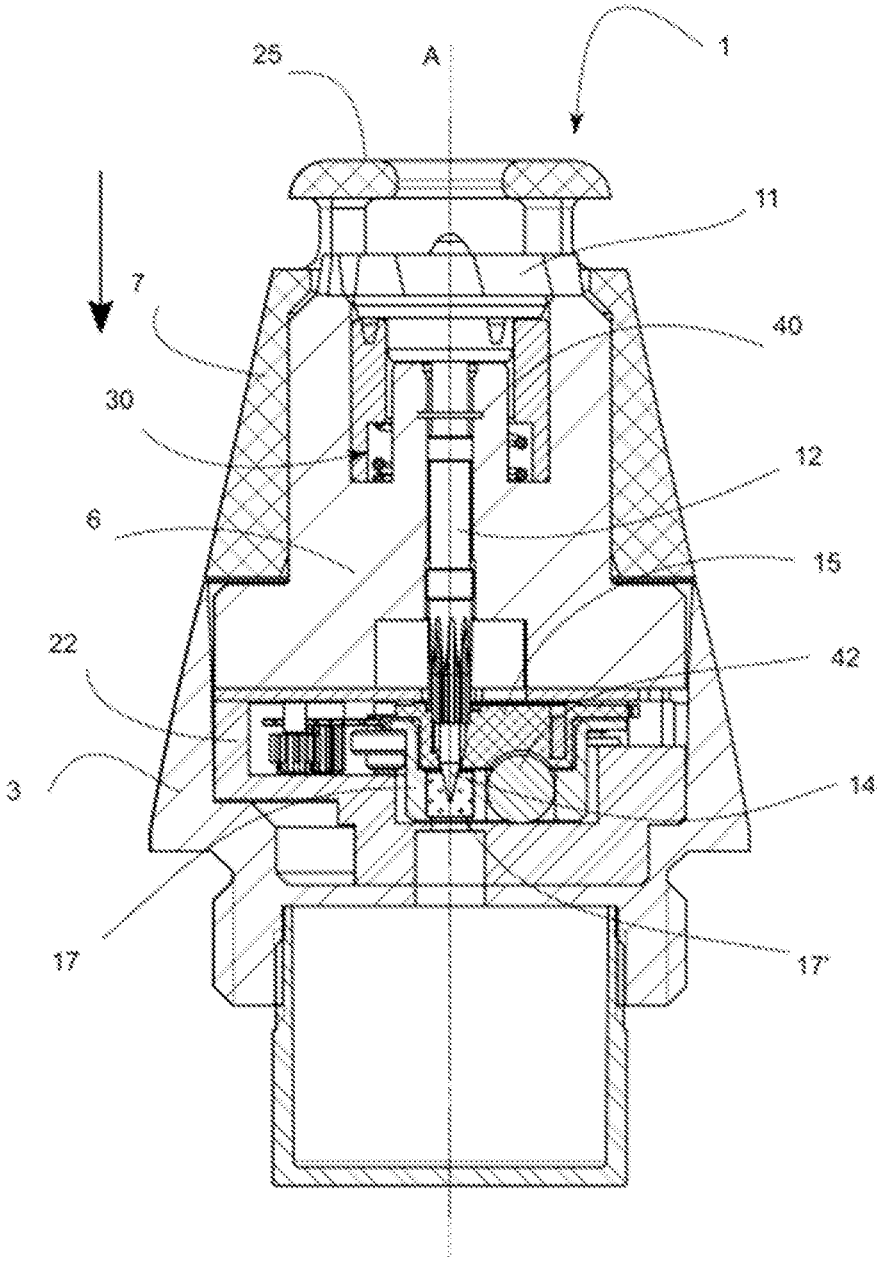
FIG. 11 is a view similar to FIG. 9, showing the fuze in the detonation position.

In the example illustrated in FIGS. 6 to 8, the locking member 41 is arranged to link the primer holder 17 to the safety device holder 22, itself linked to the fuze body 2. It comprises a ball 42 provided in a passing through axial housing 43 provided in the primer holder 17 and encased with a hemispherical footprint 44 provided in the safety device holder 22. Any other technically equivalent locking means can be suitable.

Upon starting firing, and under the effect of linear acceleration of the ammunition, the wind turbine 11 is released and the inertial lock 18 releases the primer holder 17 and simultaneously, the rotor 15. However, the primer holder 17 remains fixed, in the storage position, until the rotor 15 driven by the turbine 11 travels a determined angular course, and that a hemispherical footprint 45 provided in the rotor 15 is positioned facing the ball 42 housed in the primer holder 17, to enable it to rise and release the primer holder 17. Naturally, any other technically equivalent indexing means can be suitable.

The primer holder 17 is then coupled to the rotor 15 by a coupling device 46, such that the rotation of the rotor 15 drives the rotation of the primer holder 17 which moves from the storage position (FIG. 6) to the armed position (FIG. 8). In the example illustrated in FIGS. 12 to 14, the coupling device 46 comprises a coupling finger 47 provided on the primer holder 17 and a circular oblong space 48 provided on the rotor 15. The inverse configuration could also be suitable, in which the coupling finger is on the rotor and the circular oblong space is on the primer holder. The coupling finger 47 is arranged to circulate in the circular oblong space 48 on the determined angular sector during which the rotation of the rotor 15 does not drive the rotation of the primer holder 17. When the space 48 abuts against the coupling finger 47, then the primer holder 17 is coupled to the rotor 15 and can be driven in rotation. Naturally, any other technically equivalent coupling means can be suitable.

The operation of the fuze 1 according to the invention is described below.

Storage Position

In the storage position, such as represented in FIGS. 2 to 4, 6 and 12, the fuze 1 assembled to an ammunition is in a safe state, since the primer 17' integrated in the primer holder 17 is misaligned from the pyrotechnical chain and from the firing pin 14. The primer holder 17 constitutes the switch of the pyrotechnical chain, and is itself kept in a misaligned position by the two independent safety elements:

- the inertial lock 18,
- the locking member 41 which links the primer holder 17 to the safety device holder 22. As the rotor 15 does not rotate, the ball 42 of the locking member 41 is not released from the hemispherical footprint 44 of the safety device holder 22, and the primer holder 17 cannot move. The rotor 15 is kept in the storage position by the axis of the firing pin 14 with which it meshes and which corresponds to the drive shaft 12 of the wind turbine 11. As the drive shaft 12 is immovable, the mechanism 10 cannot initiate any movement. The wind turbine 11 is itself kept fixed over two degrees of freedom: in axial translation, by the return member 31 of the locking system 30 which keeps it flattened towards the top against the cap 11, via the inertial socket 13, and in rotation by the axial indexing finger 32 housed in the corresponding axial orifice 33 of the inertial socket 13, itself rotatably blocked via the radial guiding finger 34.

Starting Firing

Upon starting firing, such as illustrated in FIG. 5, under the effect of linear acceleration of the ammunition, the inertial lock 18 is retracted and releases the primer holder 17 and the rotor 15. Simultaneously, the inertial socket 13 of the locking system 30 of the turbine is moved towards the bottom in the annular housing 21 of the cap holder 6. The ball 37 of the blocking element 36, located in the lateral housing 38 of the inertial socket 13 descends at the same time, and, as soon as it meets the lateral opening 39 provided in the cap holder 6, is housed there. When the linear acceleration stops, the ball 37 acts like a lock and blocks the raising of the inertial socket 13. The wind turbine 11 is released and driven in rotation by the airflow generated by the flight of the ammunition.

In Flight to the Armed Position

Figure 12:
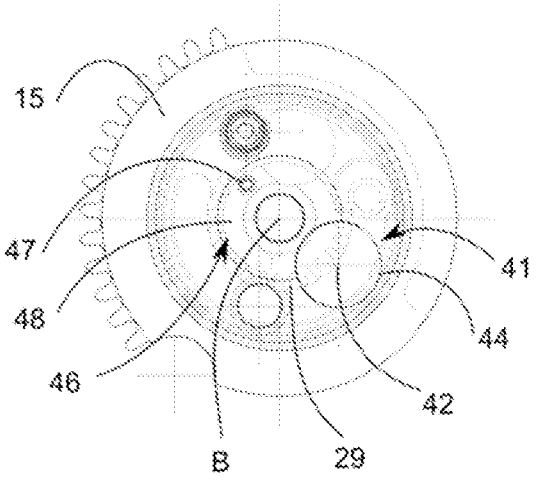
FIG. 12 is a bottom view of the rotor driven by the wind turbine, while the primer holder is in the storage position according to FIG. 6.
Figure 13:
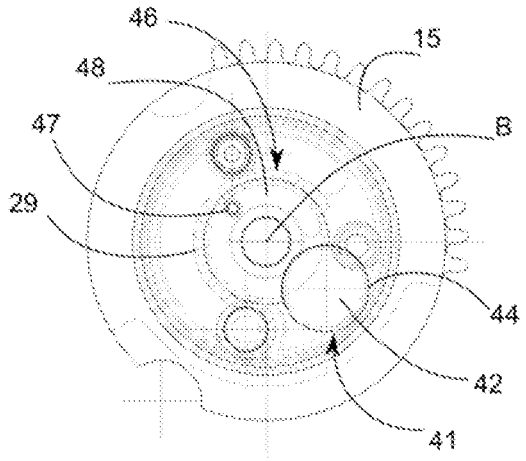
FIG. 13 is a view similar to FIG. 12, showing the rotor driven by the wind turbine, in an intermediate position according to FIG. 7.
Figure 14:
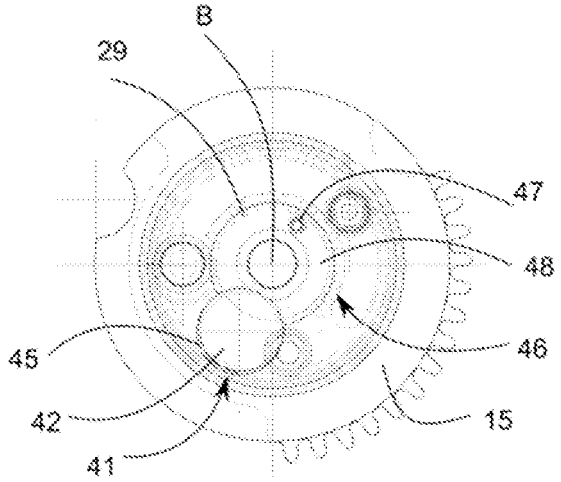
FIG. 14 is a view similar to FIG. 12, showing the rotor driven by the wind turbine, moving the primer holder into the armed position according to FIG. 8.

The rotation of the wind turbine 11 creates the motor energy of the rotor 15 and transmits it to it via the drive shaft 12 of the turbine with which it meshes. The chronometric gear train 16 regulates the rotation movement of the rotor 15. The primer holder 17 is still kept in the storage position by the action of the ball 42 of the locking member 41, positioned in the hemispherical footprint 44 of the safety device holder 22 (FIGS. 6 and 12). When the rotor 15 has travelled a sufficient angular sector, which is determined by the abutment of the coupling finger 47 of the coupling device 46, secured to the primer holder 17, with the corresponding end of the circular oblong space 48 of the rotor 15, the hemispherical footprint 45 provided in the rotor 15 appears above the ball 42 (FIGS. 7 and 13). The ball 42 is thus free to rise in this footprint. The primer holder 17 is released from its connection with the safety device holder 22 and is now driven in rotation by the rotor 15. It is the wind turbine 11 which drives the final movement via its drive shaft 12 which meshes with the rotor 15. The drive shaft 12 brings the primer holder 17 into the armed position, the latter now being linked to the rotor 15 by way of the coupling finger 47 and of the ball 42. In the meantime, the rotor 15 is no longer connected to the chronometric gear train 16, and the alignment of the primer holder 16 is instantaneous (FIGS. 8 and 14).

Upon Impact on a Target

The drive shaft 12 of the turbine 11, which is found to be combined with the firing pin 14, faces the primer 17' which contains the detonator of the pyrotechnical chain. During the impact of the ammunition on a target, the deformation of the cap 7 makes the entire wind turbine 11 descend. The collar 40 which keeps the drive shaft 12 from the turbine and from the firing pin 14 at its initial height, is sized in order to remain integrated during the storage, starting firing and flight of the ammunition phases, but not to resist an impact on a target. Under the effect of the impact transmitted by the cap 7, the collar 40 breaks and enables the firing pin 14 to descend to ram the primer 17' and initiate the pyrotechnical chain, leading to the destruction of the ammunition by explosion.

It clearly appears from the description, that the invention makes it possible to achieve the aims set. In particular, the relative movement of the air during the flight of the ammunition generates the motor torque necessary for the alignment of the primer holder 17 with the firing pin 14 and the pyrotechnical chain. The rotation torque transmitted by the wind turbine 11 is directly linked to the movement speed of the ammunition. Thus, when the speed increases, the torque increases, and the alignment time reduces. This kinematic chain enables the mechanism 10 to have the same safety distance and the same certain arming distance, whatever the load at which the ammunition is fired. Furthermore, the drive shaft 12 of the wind turbine 11 fulfils three functions: keeping the mechanism 10 in the safety position, transmission of the rotation torque to the primer holder 17 and percussion of the primer 17'.

The present invention is naturally not limited to the examples of embodiments described, but extends to any modification and variant which are clear for a person skilled in the art by remaining within the limit of the accompanying claims. Furthermore, the invention extends to any other non-gyratory ammunition or projectile, as an example, illumination rounds, etc.

The invention claimed is:

1. A mechanical self-percussion fuze for a non-gyratory ammunition, said fuze comprising a fuze body extending along a central axis between a distal end provided with a cap and a proximal end provided with a connector to assemble said fuze to an ammunition, said fuze comprising a firing pin disposed along said central axis, a primer provided in a primer holder arranged to be rotatably movable about an axis of rotation parallel and off-centered with respect to said central axis between at least one storage position, wherein said primer is off-centered with respect to said firing pin and an armed position, in which said primer is aligned with said firing pin and a pyrotechnical chain of said ammunition, and a mechanism provided with at least two safety devices, coupled to said primer holder to keep said fuze in a safe state, until at least two mutually independent physical phenomena linked to the firing of the ammunition occur, wherein a wind turbine arranged to be driven in rotation by the relative movement of the air with respect to the ammunition during the ammunition's flight and to generate a rotation torque necessary for the operation of said mechanism which regulates the time necessary for the fuze to move from the safe state to an armed state, thus guaranteeing an expected safety distance, whatever the load with which the ammunition is fired.

2. A fuze according to claim 1, wherein said wind turbine is provided with a drive shaft, aligned with the central axis of said fuze body and secured to said firing pin.

3. A fuze according to claim 1, wherein said wind turbine comprises blades which extend radially from a central zone, and wherein the cap of said fuze comprises at least one axial air inlet orifice to the right of said central zone and B several radial air flow orifices at an outlet of said blades to cause the rotation of said wind turbine in a direction of rotation.

4. A fuze according to claim 1, further comprising a locking system arranged to, in a locked position, prevent the rotation of the wind turbine and keep the fuze in said safe state before firing the ammunition, and in an unlocked position, to enable the rotation of the wind turbine after firing the ammunition.

5. A fuze according to claim 4, wherein said locking system comprises an inertial socket associated with a return member, and wherein said inertial socket is slidingly mounted in the central axis of said fuze body, to be movable between said locked position, wherein said inertial socket is subjected by said return member in a high position and rotatably blocks said wind turbine, and said unlocked position, wherein said inertial socket is moved in a low position under the effect of the linear acceleration upon starting firing, constrains said return member and releases the rotation of said wind turbine.

6. A fuze according to claim 5, wherein said locking system further comprises at least one axial indexing finger provided on one of the parts of said wind turbine or of said inertial socket and an axial orifice provided on the other of the parts of said inertial socket or of said wind turbine, said axial indexing finger being housed in said axial orifice when said inertial socket is in a high position in said locked position to rotatably block said wind turbine.

7. A fuze according to claim 5, wherein said locking system further comprises at least one radial guiding finger provided on one of the parts of said fuze body or of said inertial socket, and an axial groove provided on the other of the parts of said inertial socket or of said fuze body, said radial guiding finger being housed in said axial groove, then said inertial socket is in the high position in said locked position to rotatably block said inertial socket.

8. A fuze according to claim 5, wherein said locking system further comprises a blocking element arranged to keep said inertial socket in the low position in said unlocked position.

9. A fuze according to claim 8, wherein said blocking element comprises at least one ball in a lateral housing provided in one of the parts of said inertial socket or of said fuze body, and a lateral opening provided in the other of the parts of said fuze body or of said inertial socket, said ball being arranged to be moved between said lateral housing and said lateral opening when they face one another.

10. A fuze according to claim 1, further comprising at least one inertial lock arranged to link said primer holder to said fuze body and keep said primer holder in the storage position, and wherein said inertial lock forms part of the other of said safety devices, which reacts to one of the two mutually independent physical phenomena, linked to the firing of said round which is the linear acceleration upon starting firing.

11. A fuze according to claim 1, further comprising at least one locking member arranged to link said primer holder to said fuze body and keep said primer holder in the storage position, and wherein said locking member forms part of one of said safety devices, which reacts to the other of the two mutually independent physical phenomena, linked to the firing of said round, which is the linear speed of the ammunition during the ammunition's flight.

12. A fuze according to claim 11, wherein said locking member comprises a ball in said primer holder, encased by a hemispherical footprint of said fuze body.

13. A fuze according to claim 1, further comprising a rotor superposed to said primer holder, and wherein a drive shaft of said wind turbine comprises a motor pinion arranged to mesh a receiver pinion of said rotor and drive the receive pinion in rotation about said axis of rotation.

14. A fuze according to claim 12, further comprising a rotor superposed to said primer holder, wherein a drive shaft of said wind turbine comprises a motor pinion arranged to mesh a receiver pinion of said rotor about said and drive the receiver pinion in rotation about said axis of rotation, and wherein said rotor comprises a hemispherical footprint arranged to be positioned facing the ball in said primer holder and enable the rotor to rise to release said primer holder.

15. A fuze according to claim 13, wherein said primer holder and said rotor are coupled to one another by a coupling device on a determined angular sector, during which the rotation of said rotor drives the rotation of said primer holder moving from said storage position to said armed position.

16. A fuze according to claim 15, wherein said coupling device comprises a coupling finger provided on one of the parts of said primer holder or of said rotor, and a circular oblong space on the other of the parts of said rotor or of said primer holder.

17. A fuze according to claim 13, wherein said rotor meshes a chronometric gear train arranged to regulate the movement of said rotor.

18. A fuze according to claim 1, further comprising a collar, secured to a drive shaft of said wind turbine, arranged to break under the effect of an impact transmitted by said cap and enable said firing pin to descend and ram said primer and to initiate the pyrotechnical chain, leading to the destruction of the ammunition.

* * * * *